US006940364B2

(12) United States Patent
Atokawa et al.

(10) Patent No.: US 6,940,364 B2
(45) Date of Patent: Sep. 6, 2005

(54) DIELECTRIC FILTER, DIELECTRIC DUPLEXER, AND COMMUNICATION APPARATUS

(75) Inventors: Masayuki Atokawa, Omihachiman (JP); Hitoshi Tada, Moriyama (JP); Hideyuki Kato, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/805,353

(22) Filed: Mar. 22, 2004

(65) Prior Publication Data

US 2004/0239445 A1 Dec. 2, 2004

(30) Foreign Application Priority Data

May 9, 2003 (JP) ..... 2003-131961
Jan. 15, 2004 (JP) ..... 2004-008472

(51) Int. Cl.[7] ..... H01P 5/12; H01P 1/205
(52) U.S. Cl. ..... 333/134; 333/206
(58) Field of Search ..... 333/134, 206, 333/207

(56) References Cited

U.S. PATENT DOCUMENTS 5,528,204 A * 6/1996 Hoang et al. ..... 333/134
6,281,768 B1 * 8/2001 Tada et al. ..... 333/206
6,597,263 B2 * 7/2003 Jun et al. ..... 333/202

FOREIGN PATENT DOCUMENTS

| | | |
|---|---|---|
| JP | 62-077703 | 4/1987 |
| JP | 2-145804 | 11/1990 |
| JP | 05-335808 | 12/1993 |
| JP | 09-064616 | 3/1997 |
| JP | 10-256807 | 9/1998 |
| JP | 11-154803 | 6/1999 |

* cited by examiner

*Primary Examiner*—Seungsook Ham
(74) *Attorney, Agent, or Firm*—Dickstein, Shapiro, Morin & Oshinsky, LLP.

(57) ABSTRACT

A dielectric filter provided with a dielectric block including at least four resonant through holes that are adjacent to each other. A multipath slot is arranged near three adjacent through holes of the at least four resonant through holes. The multipath slot has an inner conductor formed on an inner surface thereof in order to generate a first capacitance between a first area near the open end of each of the three adjacent through holes and the inner conductor of the multipath slot. A step is formed so that a second capacitance is generated between a second area near the open end of each of two through holes of the at least four resonant through holes and an outer conductor located within the step. An attenuation peak is generated at the lower-frequency side of the passband with the multipath slot and the three adjacent through holes, and an attenuation peak is generated at the higher-frequency side of the passband with the two through holes and the outer conductor within the step.

13 Claims, 10 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter and a dielectric duplexer for use in a high-frequency circuit, and to a communication apparatus provided with the dielectric filter or the dielectric duplexer.

2. Description of the Related Art

Dielectric filters provided with a plurality of resonance lines in a dielectric block are disclosed in the following three publications.

Japanese Unexamined Patent Application Publication No. 9-64616 discloses a dielectric filter in which a recess (slot) inside which a conducting film is formed is provided on the open-end face of a dielectric block in order to capacitively couple resonance lines to each other.

Japanese Unexamined Patent Application Publication No. 5-335808 discloses a dielectric filter in which a groove inside which a conducting film is formed is provided at an end face of a dielectric block so that a capacitance is generated between areas near the open ends of resonance lines and the groove.

Japanese Unexamined Patent Application Publication No. 10-256807 discloses a dielectric filter in which each resonant through hole has a stepped form. The central axis of a large-diameter hole is largely deviated from the central axis of a small-diameter hole to form a flexed resonant through hole.

Generating attenuation peaks by coupling through holes to each other and setting the pitch between the through holes as required allows the frequencies of attenuation peaks to be controlled to desired frequencies.

FIGS. 9A to 9D show a structure example of a known dielectric duplexer; FIG. 9A is a top view of the dielectric duplexer, FIG. 9B is a front view of the dielectric duplexer, FIG. 9C is a bottom view of the dielectric duplexer, and FIG. 9D is a right-side view of the dielectric duplexer. A substantially rectangular-parallelepiped dielectric block 1 of the dielectric duplexer has a plurality of resonant through holes 2*a* to 2*c*, 3, 4*a* to 4*d*, and 5, each having a conductor formed inside. Each ground hole 6 is provided between the resonant through holes 2*a* and 3, between the resonant through holes 2*c* and 4*a*, and between the resonant through holes 4*d* and 5 in order to block the coupling therebetween. A conducting film is formed inside the overall ground hole 6, and the opposing ends of the conducting film are connected to an outer conductor 10.

The dielectric block 1 also has excitation through holes 7, 8, and 9, each having a conductor formed inside. The outer conductor 10 is formed on the outer surfaces of the dielectric block 1. One end of each of the excitation through holes 7, 8, and 9 is connected to the outer conductor 10 on one end face of the dielectric block 1. A transmission terminal 17, an antenna terminal 18, and a reception terminal 19 are formed on the other ends of the excitation through holes 7, 8, and 9, respectively, and extend toward a surface to be mounted on a board. The resonant through holes 2 to 5 are stepped holes, each having a larger inside diameter at its open end (the opposing side of the front side in FIG. 9B) and having a smaller inside diameter at its short-circuited end (the front side in FIG. 9B). In the structure example in FIGS. 9A to 9D, a resonator formed by the through hole 4*a* is capacitively coupled (C coupling) to a resonator formed by the through hole 4*b*, a resonator formed by the through hole 4*b* is inductively coupled (L coupling) to a resonator formed by the through hole 4*c*, and a resonator formed by the through hole 4*c* is capacitively coupled (C coupling) to a resonator formed by the through hole 4*d*.

FIG. 10 is a graph showing a transmission characteristic between the antenna terminal 18 and the reception terminal 19 of the dielectric duplexer in FIG. 9A to 9D. An attenuation peak Pab occurs by coupling the resonator formed by the through hole 4*a* to the resonator formed by the through hole 4*b*. An attenuation peak Pbc occurs by coupling the resonator formed by the through hole 4*b* to the resonator formed by the through hole 4*c*. An attenuation peak Pcd occurs by coupling the resonator formed by the through hole 4*c* to the resonator formed by the through hole 4*d*. The pitch between the through holes 4*c* and 4*d* is set to be smaller than the pitch between the through holes 4*a* and 4*b* so that the attenuation peak Pcd occurs near the passband.

In any of the dielectric filters disclosed in the above publications, the resonant through holes are arranged at pitches set in accordance with the characteristics in order to couple the resonators to each other with predetermined degrees of capacitive or inductive coupling. In other words, since the frequencies of the attenuation peaks are varied in accordance with the pitches between the resonant through holes, the frequency positions of the attenuation peaks with respect the passband are controlled in accordance with the pitches between the resonant through holes. As a result, in many cases where three or more resonant through holes are provided, the pitches between the resonant through holes are varied, as described above.

However, since the variation in size of the molded dielectric block is associated with the variation in electrical characteristics of the dielectric filter, areas in which the pitches between the resonant through holes are small are largely affected by the variation in size of the molded dielectric block, thus leading the increase in a defective factor in the manufacturing. Furthermore, the current density flowing through the resonance through holes is increased in the areas in which the pitches between the resonant through holes are small and, therefore, unloaded Q (Q0) of the resonators is decreased. This constitutes a factor in preventing the characteristic improvement due to the provision of the attenuation peaks.

SUMMARY OF THE INVENTION

In order to solve the above problems, it is an object of the present invention to provide a dielectric filter and a dielectric duplexer having attenuation peaks at both the higher-frequency side and the lower-frequency side of the passband without extremely decreasing the pitches between resonant through holes and to provide a communication apparatus provided with the dielectric filter or the dielectric duplexer.

The present invention provides, in its first aspect, a dielectric filter provided with a dielectric block including at least four resonant through holes that are adjacent and parallel to each other, each of the resonant through holes having a conductor formed inside; an outer conductor formed outside the dielectric block; a multipath slot; and a step. The multipath slot has an inner conductor formed inside, which is separated from the outer conductor, and is arranged near three adjacent resonant through holes among the at least four resonant through holes, in order to generate a capacitance between an area near the open end of each of the three adjacent through holes and the inner conductor inside the multipath slot. The step has the outer conductor formed inside and is formed outside the dielectric block, in order to generate a capacitance between an area near the open end of each of two resonant through holes, including one of the three resonant through holes and a resonant through hole other than the three resonant through holes, and the outer conductor inside the step.

In this dielectric filter, the resonators formed by three adjacent resonant through holes, among the at least four resonant through holes, are capacitively coupled to each other in order to generate an attenuation peak at the lower-frequency side of the passband. The presence of the step increases the capacitance between the area near the open end of each of the two resonant through holes and the outer conductor in order to inductively couple the resonators formed by the two resonant through holes to each other. With this structure, each attenuation peak can be generated at the lower-frequency side and the higher-frequency side of the passband and a larger attenuation can be attained at the lower-frequency side.

The dielectric block preferably further includes excitation through holes, each having a conductor formed inside, and resonant through holes, each having a conductor formed inside. The excitation through hole is coupled to any of the at least four resonant through holes. The resonant through hole is coupled to the corresponding excitation line.

With this structure, the resonant through hole coupled to the excitation through hole functions as a trap resonator, so that it is possible to further attenuate signals within a predetermined frequency band at the higher-frequency side or the lower-frequency side of the passband.

The dielectric block preferably further includes an input terminal and an output terminal formed on an outer surface of the dielectric block, which is mounted on a board. The multipath slot is arranged near an outer surface opposing the outer surface which is mounted on the board.

With this structure, it is less liable to generate a stray capacitance between other parts that are adjacent to the dielectric filter on the board and the inner conductor inside the multipath slot or between electrodes on the board and the inner conductor inside the multipath slot, thus suppressing a change in characteristics after the dielectric block has been mounted on the board.

The present invention provides, in its second aspect, a dielectric duplexer having a transmission filter and a reception filter. Either the transmission filter or the reception filter, which has a higher-frequency passband, is the dielectric filter having the structure described above.

With this dielectric duplexer, a larger attenuation peak is generated at the lower-frequency side of the passband and, therefore, it is less liable to affect a frequency band of the transmission filter or the reception filter, which has a lower-frequency passband, or to be affected by the frequency band.

The present invention provides, in its third aspect, a communication apparatus provided with a communication-signal processing circuit including the above dielectric filter or the above dielectric duplexer.

With this structure, it is possible to realize a compact communication apparatus having superior high-frequency circuit characteristics.

DESCRIPTION OF THE PREFERRED EMBODIMENTS

Figure 1B:
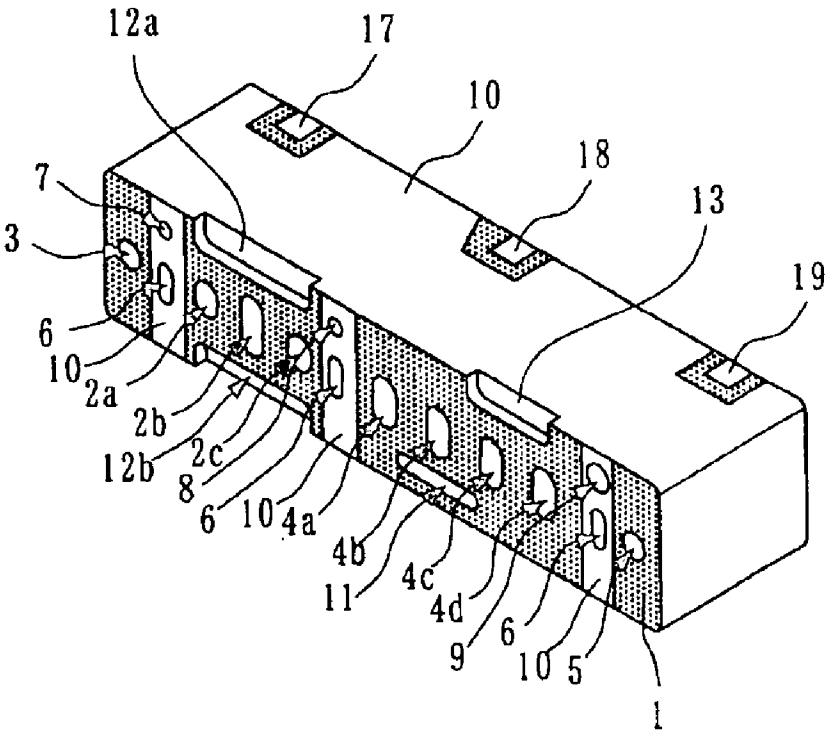
FIG. 1B is a perspective view of the dielectric duplexer of the first embodiment in which the top face shows the surface to be mounted on the board.
Figure 1A:
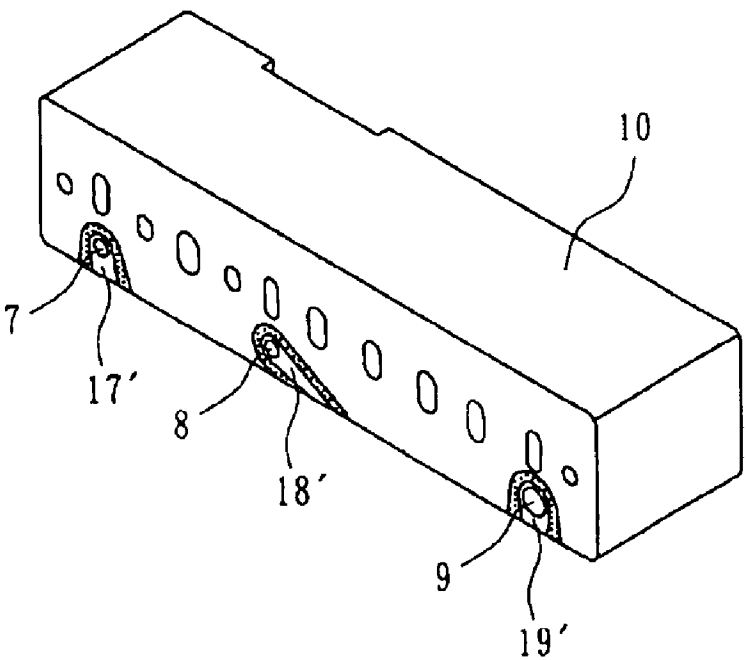
FIG. 1A is a perspective view of a dielectric duplexer according to a first embodiment of the present invention and shows the dielectric duplexer mounted on a board.

FIGS. 1A and 1B are perspective views of a dielectric duplexer according to a first embodiment of the present invention; FIG. 1A is a perspective view showing the dielectric duplexer mounted on a board; and FIG. 1B is a perspective view of the dielectric duplexer in which the top face shows the surface to be mounted on the board.

A substantially rectangular-parallelepiped dielectric block 1 of the dielectric duplexer has a plurality of resonant through holes 2*a* to 2*c*, 3, 4*a* to 4*d*, and 5, each having a conductor formed inside. The dielectric block 1 also has excitation through holes 7, 8, and 9, each having a conductor formed inside. An outer conductor 10 is formed on almost the entire outer surfaces of the dielectric block 1, except for an outer surface at the proximal left end in FIG. 1B. One end of each of the excitation through holes 7, 8, and 9 is connected to the outer conductor 10 on one end face of the dielectric block 1. A transmission terminal 17, an antenna terminal 18, and a reception terminal 19 are formed on the other ends of the excitation through holes 7, 8, and 9, respectively, and extend toward the surface to be mounted on the board. The resonant through holes 2*a* to 2*c*, 3, 4*a* to 4*d* and 5 are preferably stepped holes, each having a larger inside diameter at its open end (at the proximal left side of the dielectric block 1 in FIG. 1B) and having a smaller inside diameter at its short-circuited end (the distal right side of the dielectric block 1 in FIG. 1B).

A multipath slot 11 having a predetermined width, a predetermined length, and a predetermined depth is formed at a position near the resonant through holes 4*a*, 4*b*, and 4*c*. The multipath slot 11 has a conducting film formed inside. A capacitance is generated between the conducting film inside the multipath slot 11 and an area near the open end of each of the resonant through holes 4*a*, 4*b*, and 4*c*. An attenuation peak occurs at the lower-frequency side of the passband because of the capacitance generated between the conducting film inside the multipath slot 11 and the area near the open end of each of the resonant through holes 4*a*, 4*b*, and 4*c*.

A step 13 is formed near the open ends of the resonant through holes 4*c* and 4*d*. The outer conductor 10 extends toward the inner face of the step 13. The presence of the step 13 increases a capacitance between the open ends of the resonant through holes 4*c* and 4*d* and the outer conductor 10 inside the step 13, thus increasing the degree of inductive coupling between resonators formed by the resonant through holes 4*c* and 4*d*.

Steps 12*a* and 12*b* are formed in order to increase capacitances between areas near the open ends of the resonant through holes 2*a*, 2*b*, and 2*c* and the outer conductor 10. The presence of the steps 12*a* and 12*b* increase the capacitances between the open ends of the resonant through holes 2*a*, 2*b* and 2*c* and the outer conductor 10 inside the steps 12*a* and 12*b*, thus increasing the degree of inductive coupling between resonators formed by the resonant through holes 2*a*, 2*b*, and 2*c*.

The outer conductor 10 is formed on part of the open-end side of the dielectric block 1 shown in FIG. 1B for connecting the ends of the excitation through holes 7, 8, and 9 to the outer conductor 10. Each ground hole 6 is provided between the resonant through holes 2*a* and 3, between the resonant through holes 2*c* and 4*a*, and between the resonant through holes 4*d* and 5 in order to block the coupling therebetween. A conducting film is formed inside the ground hole 6, and the opposing ends of the conducting film are connected to the outer conductor 10.

As shown in FIGS. 1A and 1B, when the side face of the dielectric block 1 on which the transmission terminal 17, the antenna terminal 18, and the reception terminal 19 are formed is mounted on the board, the multipath slot 11 is apart from the board. As a result, a stray capacitance generated between the conducting film inside the multipath slot 11 and electrodes or other parts on the board is decreased, so that it is possible to suppress a change in characteristics owing to the stray capacitance. Since the electrode of the step 13 is the outer conductor 10, which is grounded, the electrode is not affected by other surrounding parts.

Figure 2:
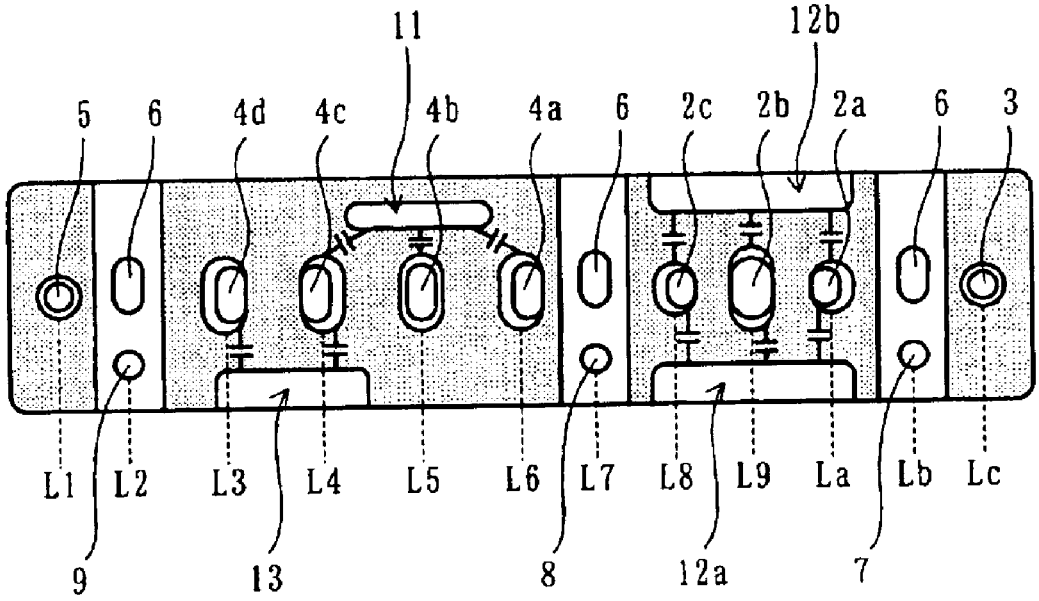
FIG. 2 is a diagram showing the correspondence of through holes to lines of the dielectric duplexer of the first embodiment.
Figure 3:
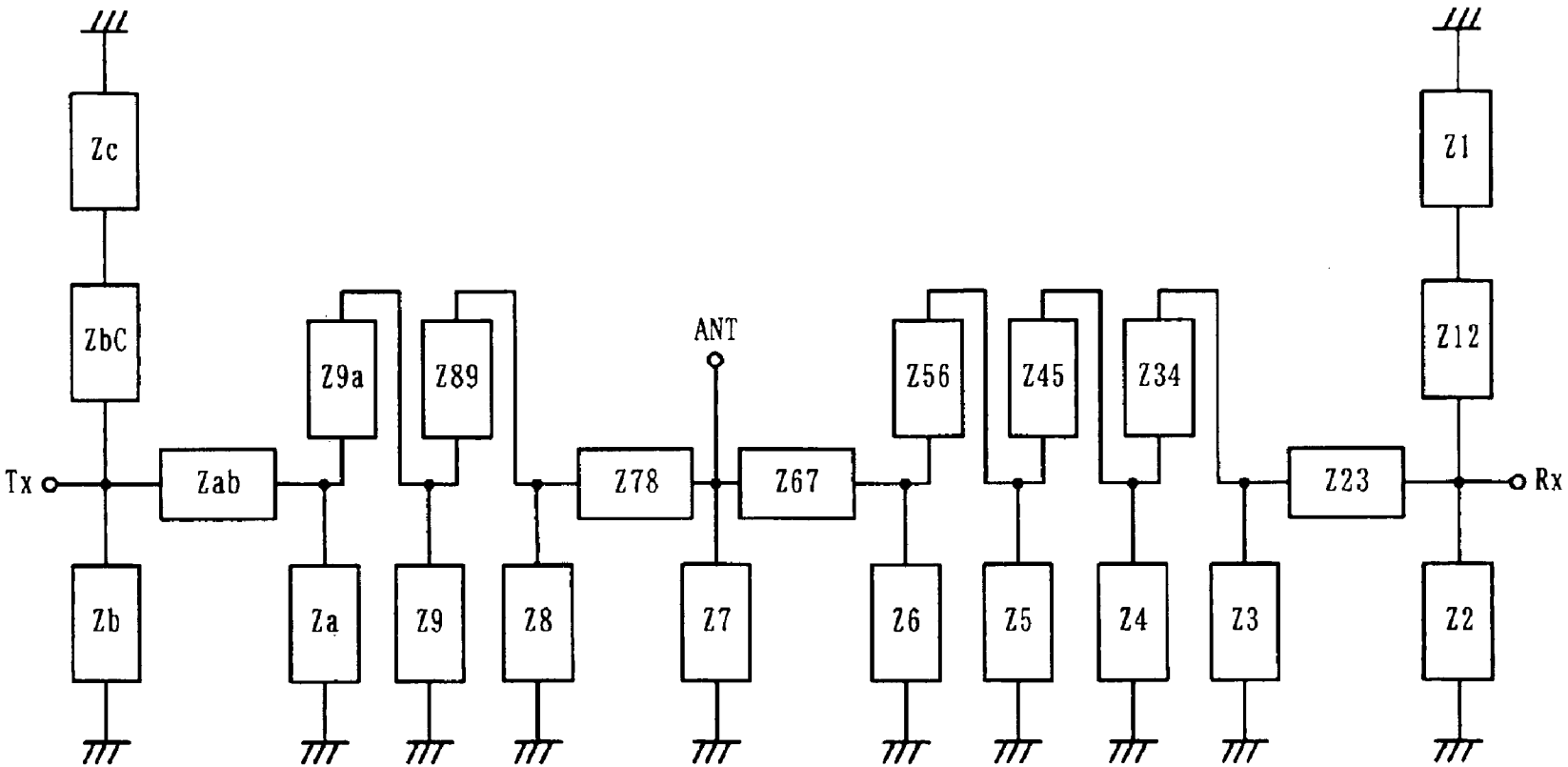
FIG. 3 is an equivalent circuit diagram of the dielectric duplexer of the first embodiment.

FIG. 3 is an equivalent circuit diagram of the dielectric duplexer in FIGS. 1A and 1B. FIG. 2 is a diagram showing the correspondence of lines in FIG. 3 to the resonant through holes 2*a* to 2*c*, 3, 4*a* to 4*d* and 5 and the excitation through holes 7 to 9. Referring to FIG. 3, adscript letters added to Z, such as in Z1 and Z2, correspond to the serial numbers of the lines in FIG. 2. Impedances having a one-digit adscript letter, such as Z1, denote self impedances of the resonant through hole or the excitation through hole, while impedances having two-digit adscript letters, such as Z12 and Z23, denote coupling impedances occurring between the resonant through holes coupled to each other or between the resonant through hole and the excitation through hole.

Z12 denotes a coupling impedance between lines L1 and L2, and Zbc denotes a coupling impedance between lines Lb and Lc. Z23 is a coupling impedance between lines L2 and L3, Z67 denotes a coupling impedance between lines L6 and L7, Z78 denotes a coupling impedance between lines L7 and L8, and Zab denotes a coupling impedance between the lines La and Lb.

Referring to FIG. 3, since Z12 and Zbc function as circuits having a phase of $\pi/2$, Z1 is combined with Z12 to function as a trap resonator. Similarly, Zc is combined with Zbc to function as a trap resonator.

Z34 denotes an impedance indicating inductive coupling between resonance lines L3 and L4, Z45 denotes an impedance indicating capacitive coupling between resonance lines L4 and L5, and Z56 denotes an impedance indicating capacitive coupling between resonance lines L5 and L6. Z89 denotes an impedance indicating inductive coupling between resonance lines L8 and L9 and Z9*a* denotes an impedance indicating inductive coupling between resonance lines L9 and La.

According to the first embodiment, the dielectric block 1 preferably measures 20 mm wide by 5.2 mm deep by 4.5 mm high. The pitch between the resonant through holes at the short-circuited ends is set to, for example, 1.9 mm. The step 13 preferably measures 0.3 mm deep by 0.8 mm wide by 3.0 mm long so as to generate an attenuation peak around 2,050 MHz. The multipath slot 11 preferably measures 0.3 mm deep by 0.4 mm wide by 3.0 mm long so as to attain an attenuation of 48 dB or more in a transmission bandwidth.

As described above, the multipath slot 11 increases the capacitive coupling between the three resonators formed by the resonant through holes 4*a*, 4*b*, and 4*c* in the first embodiment. In addition, the resonant through holes 4*a*, 4*b*, and 4*c* are structured so as to further increase the capacitive coupling between the three resonators. In other words, the resonant through holes 4*a*, 4*b*, and 4*c* each have an inside diameter at the short-circuited end that is smaller than an inside diameter at the open end. The central axis of the inside diameter of each of the resonant through holes 4*a*, 4*b*, and 4*c* at the open end is deviated from the central axis of the inside diameter thereof at the short-circuited end so that the pitch at the open end is smaller than the pitch at the short-circuited end. The presence of the multipath slot 11 and the shape of the resonant through holes 4*a*, 4*b*, and 4*c* allow the three resonators formed by the resonant through holes 4*a*, 4*b*, and 4*c* to be further strongly and capacitively coupled to each other.

Also as described above, the steps 12*a* and 12*b* increase the inductive coupling between the three resonators formed by the resonant through holes 2*a*, 2*b*, and 2*c* in the first embodiment. In addition, the resonant through holes 2*a*, 2*b*, and 2*c* are structured so as to further increase the inductive coupling between the three resonators. In other words, the resonant through holes 2*a*, 2*b*, and 2*c* each have an inside diameter at the short-circuited end that is smaller than an inside diameter at the open end. The central axis of the inside diameter of each of the resonant through holes 2*a*, 2*b*, and 2*c* at the open end is deviated from the central axis of the inside diameter thereof at the short-circuited end so that the pitch at the open end is larger than the pitch at the short-circuited end. The presence of the steps 12*a* and 12*b* and the shape of the resonant through holes 2*a*, 2*b*, and 2*c* allow the three resonators formed by the resonant through holes 2*a*, 2*b*, and 2*c* to be further strongly and inductively coupled to each other.

Figure 4:
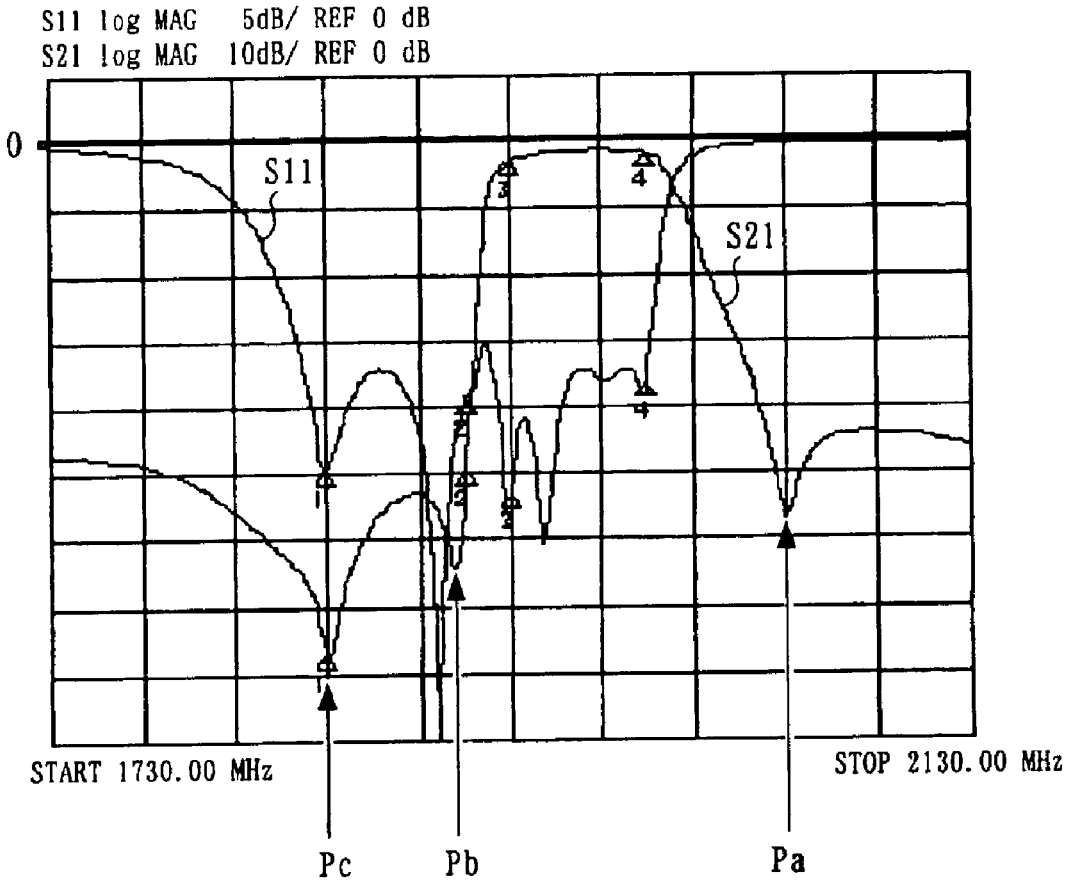
FIG. 4 is a graph illustrating characteristics between an antenna terminal and a reception terminal in the dielectric duplexer of the first embodiment.

FIG. 4 is a graph illustrating characteristics between the antenna terminal 18 and the reception terminal 19 in the dielectric duplexer. The vertical axis represents the attenuation in a transmission characteristic S21 from the antenna terminal 18 to the reception terminal 19 and in a reflection characteristic from the antenna terminal 18 to the reception terminal 19. One scale in S11 denotes 5 dB, one scale in S21 denotes 10 dB, and a bold line represents zero dB. The horizontal axis is a linear scale having a start frequency of 1,730 MHz and an end frequency of 2,130 MHz. An attenuation Pa at the higher-frequency side of the passband in the transmission characteristic S21 is generated by providing the step 13 to inductively couple the two resonators formed by the resonant through holes 4*c* and 4*d* to each other. An attenuation Pb, which occurs at the lower-frequency side of the passband and is close to the passband, and an attenuation Pc, which occurs at the lower-frequency side of Pb, are generated by providing the multipath slot 11 to capacitively couple the three resonators formed by the resonant through holes 4*a*, 4*b*, and 4*c* to each other.

With the structure of the reception filter of the dielectric duplexer according to the first embodiment, the two attenuation peaks are generated at the lower-frequency side of the passband due to the multipath slot 11, and another attenuation peak is generated due to the trap resonator described above. However, since the attenuation peak due to the trap resonator coincides with or is close to the attenuation peak Pb, only the two attenuation peaks Pb and Pc appear at the lower-frequency side of the passband in FIG. 4.

Capacitively coupling two resonators generates an attenuation peak at the lower-frequency side of the passband. Capacitively coupling the respective adjacent resonators among three resonators (CC coupling) generates two attenuation peaks at the lower-frequency side of the passband. However, structurally, a negative capacitance (capacitance jump) occurs between the first-stage resonator and the third-stage resonator. The negative capacitance causes the two attenuation peaks at the lower-frequency side to come close to each other, and the two attenuation peaks are eventually overlapped with each other and disappear, thus reducing the attenuation in the corresponding bandwidth. Although, conventionally, in order to prevent the attenuation peaks from overlapping with each other because of the capacitance jump, the first-stage resonator has been capacitively coupled to the second-stage resonator, the second-stage resonator has been inductively coupled to the third resonator, and the third-stage resonator has been capacitively coupled to the fourth resonator (CLC coupling) among four resonators, as shown in FIG. 9, there is problems of bad characteristics caused by variation in the pitches between resonant through holes and of a decrease in unloaded Q (Q0) caused by the presence of narrow pitches, as described above. In contrast, the multipath slot 11 shown in FIGS. 1A, 1B and 2 is provided in the dielectric duplexer of the present invention. Increasing the capacitance jump with the multipath slot 11 separates the attenuation peaks from each other again. Controlling the multipath capacitance can control the attenuation characteristics at the lower-frequency side of the passband.

Inductively coupling the respective adjacent resonators among three resonators (LL coupling) also generates a negative capacitance between the resonators. However, contrary to the CC coupling, one attenuation peak operates to be separated from the other attenuation peak in the LL coupling. Hence, the attenuation peaks do not disappear and, therefore, the attenuation is not reduced. Referring to FIGS. 1A, 1B, and 2, the three resonators in the transmission filter are LL-coupled to each other. Among the resonant through holes 2*a*, 2*b*, and 2*c* constituting the three resonators, increasing the inside diameter of the central resonant through hole 2*b* at the open-end side (particularly, the major axis perpendicular to the direction in which the resonant through holes 2*a*, 2*b*, and 2*c* are arranged) decreases the capacitance jump between the two resonators formed by the resonant through holes 2*a* and 2*c* in order to control the attenuation peak occurring at the higher-frequency side of the passband.

Capacitively coupling the first-stage resonator to the second-stage resonator and inductively coupling the second-stage resonator to the third-stage resonator (CL coupling) among three resonators generates an attenuation peak at the higher-frequency side of the passband and an attenuation peak at the lower-frequency side thereof. In order to attain sufficient attenuation at the lower-frequency side, as shown in FIGS. 1A, 1B, and 2, it is necessary to structure the dielectric duplexer so as to have the four resonators formed by the resonant through holes 4*a*, 4*b*, 4*c*, and 4*d* and such that three adjacent resonators are CC-coupled to each other and the remaining resonator is inductively coupled to the adjacent resonator (CCL coupling).

Figure 5A:
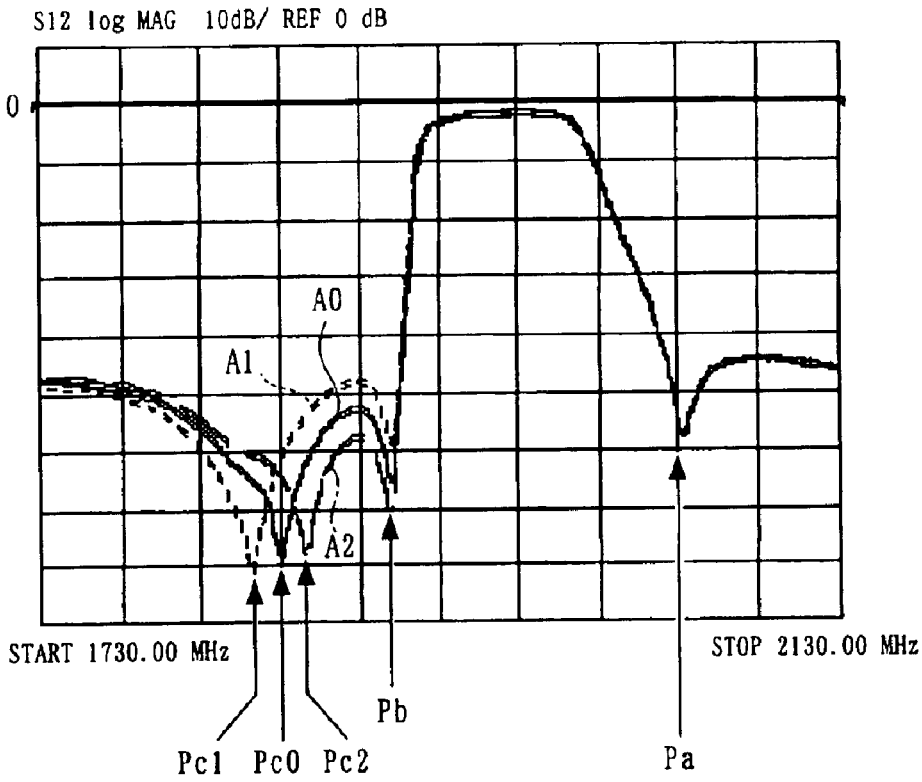
FIG. 5A is a graph illustrating the variation in transmission characteristics between the antenna terminal and the reception terminal when the size of a multipath slot is varied.

FIGS. 5A is a graph illustrating the variation in transmission characteristics between the antenna terminal 18 and the reception terminal 19 when the size of the multipath slot 11 is varied. Referring to FIG. 5A, A0 represents a characteristic when the size of the multipath slot 11 is set to a predetermined value, and is equal to the transmission characteristic S21 in FIG. 4. A1 represents a characteristic when the capacitance generated between the resonant through holes 4*a*, 4*b*, and 4*c* and the outer conductor 10 is increased with the multipath slot 11, and A2 represents a characteristic when the capacitance generated between the resonant through holes 4*a*, 4*b*, and 4*c* and the outer conductor 10 is decreased with the multipath slot 11.

Increasing the capacitance through the conducting film inside the multipath slot 11 by, for example, providing the multipath slot 11 near the resonant through holes 4*a*, 4*b*, and 4*c* in FIG. 1A, increasing the depth of the multipath slot 11, or increasing the length of the dielectric block 1 shifts an attenuation peak Pc at the lower-frequency side to lower frequencies, as shown by Pc1. To the contrary, decreasing the capacitance through the conducting film inside the multipath slot 11 by, for example, providing the multipath slot 11 away from the resonant through holes 4*a*, 4*b*, and 4*c* in FIG. 1A, decreasing the depth of the multipath slot 11, or decreasing the length of the dielectric block 1 shifts an attenuation peak Pc at the lower-frequency side to higher frequencies, as shown by Pc2. An attenuation peak Pa at the higher-frequency side of the passband hardly shifts.

The attenuation of an attenuation peak Pb, which occurs at the lower-frequency side of the passband and is close to the passband, decreases as the frequency of the attenuation peak Pc at the lower-frequency side of the attenuation Pb shifts toward lower frequencies. Hence, the position and size of the multipath slot 11 is determined so that a frequency band and an attenuation required at the lower-frequency side of the passband are achieved.

Figure 5B:
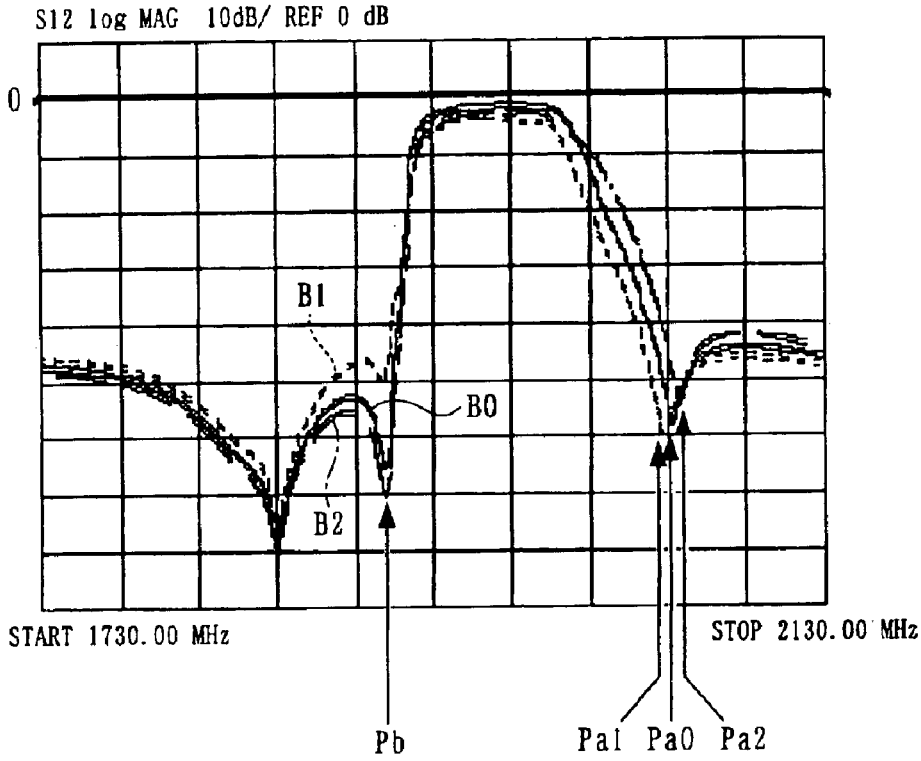
FIG. 5B a graph illustrating the variation in the transmission characteristics between the antenna terminal and the reception terminal when the size of a step is varied.

FIG. 5B is a graph illustrating the variation in the transmission characteristics between the antenna terminal 18 and the reception terminal 19 when the size of the step 13 is varied. B0 represents a characteristic when the size of the step 13 is set to a predetermined value, which is a value when the characteristics in FIG. 4 are attained. B1 represents a characteristic when the capacitances generated between the resonant through holes 4*c* and 4*d* and the outer conductor 10 are increased with the step 13, and B2 represents a characteristic when the capacitances generated between the resonant through holes 4*c* and 4*d* and the outer conductor 10 are decreased with the step 13. As shown in FIG. 5B, as the capacitance generated in the step 13 is increased, the degree of the inductive coupling between the resonators is increased, thus shifting the attenuation peak Pa at the higher-frequency side of the passband toward lower frequencies, as shown by Pa1. In contrast, as the capacitance generated in the step 13 is decreased, the attenuation peak Pa shifts toward higher frequencies, as shown by Pa2. As the frequency of the attenuation peak Pa at the higher-frequency side shifts toward lower frequencies, the attenuation of the attenuation peak Pb at the lower-frequency side is decreased. Hence, the size of the step 13 is determined in accordance with the attenuation characteristics required in predetermined frequency bands at the higher-frequency side and the lower-frequency side of the passband.

As described above, the frequencies of the attenuation peaks can be set without changing the pitch between the resonators. Since casting the dielectric block 1 by using a mold can stably set the size of the multipath slot 11, the variation in characteristics is small and the quality is improved without a factor of increasing the cost, such as characteristic control, thus generally decreasing the cost.

Figure 6:
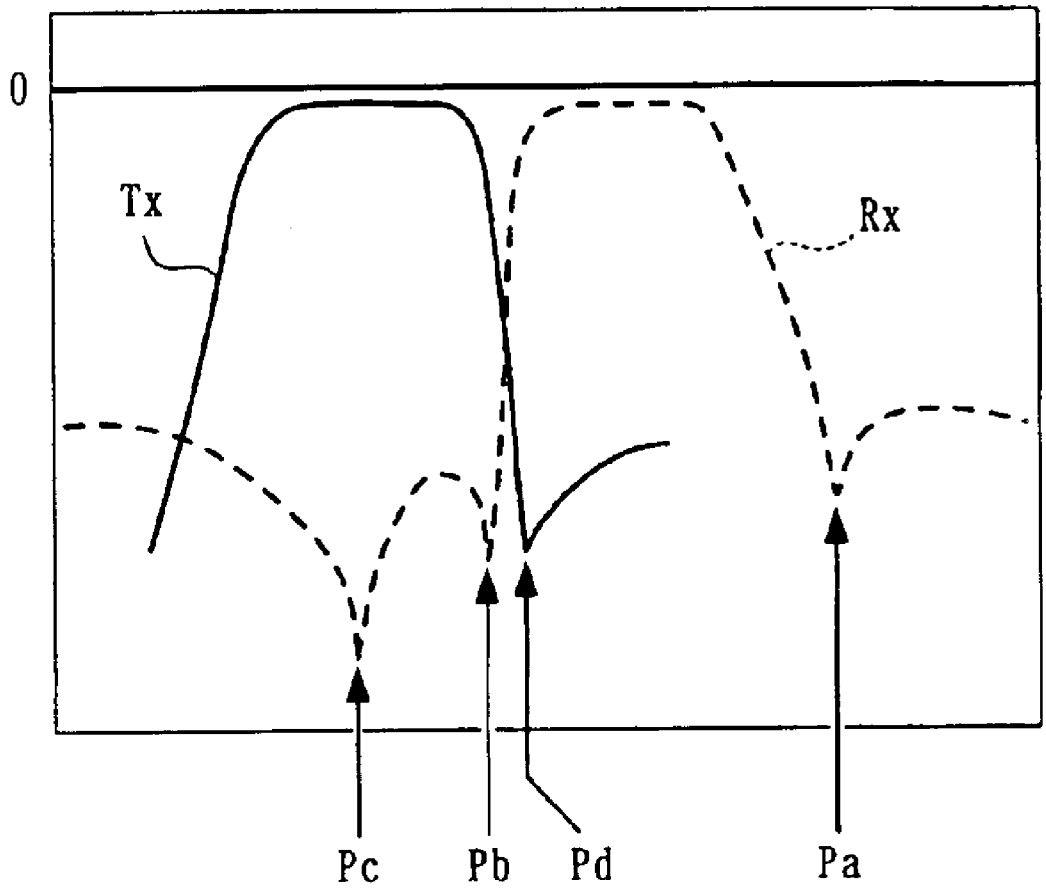
FIG. 6 is a graph illustrating transmission characteristics of a reception filter and a transmission filter in the dielectric duplexer of the first embodiment.

FIG. 6 is a graph illustrating transmission characteristics of the reception filter and the transmission filter in the dielectric duplexer according to the first embodiment of the present invention. Rx denotes the transmission characteristic of the reception filter and Tx denotes the transmission characteristic of the transmission filter. As shown in FIG. 6, the lower-frequency side is used as the transmission frequency band and the higher-frequency side is used as the reception frequency band. Attenuation peaks Pb and Pc at the lower-frequency side attenuate the signals within a predetermined frequency band in the transmission frequency band. An attenuation Pa at the higher-frequency side eliminates unnecessary signals within a predetermined frequency band at the higher-frequency side of the reception frequency band. An attenuation peak Pd of the transmission filter at the higher-frequency side of the passband, which is caused by the inductive coupling due to the steps 12*a* and 12*b*, attenuates signals within a predetermined frequency band in the reception frequency band.

Three structure examples of a dielectric duplexer according to a second embodiment of the present invention will now be described with reference to FIGS. 7A to 7C.

Figure 7A:
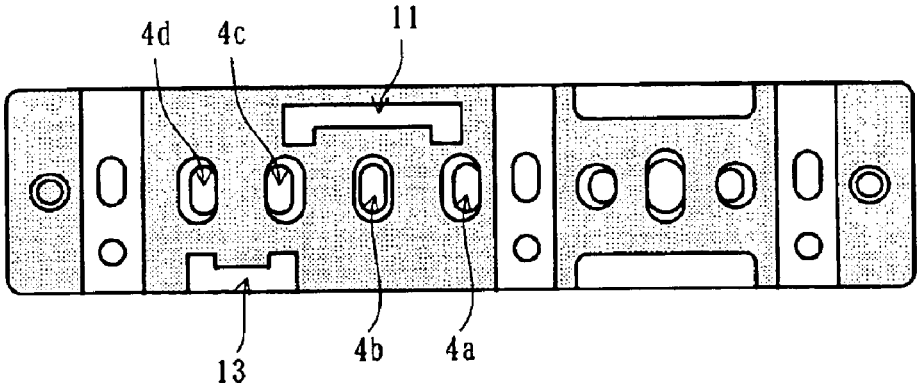
FIGS. 7A to 7C are front views of dielectric duplexers, according to a second embodiment of the present invention, at their open-end side.
Figure 7B:
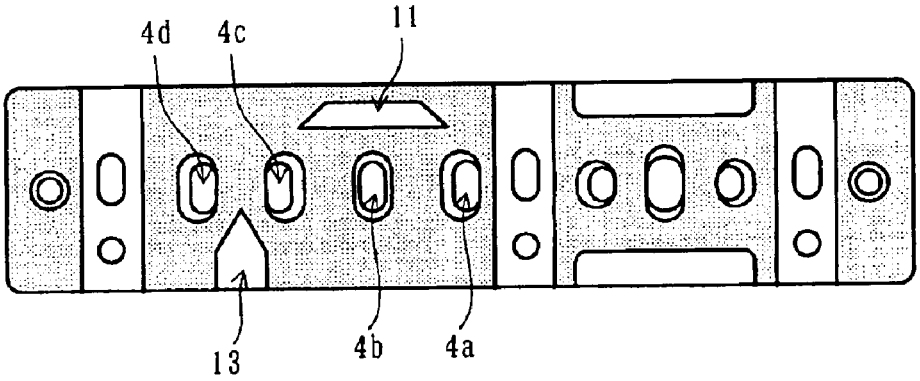
Figure 7C:
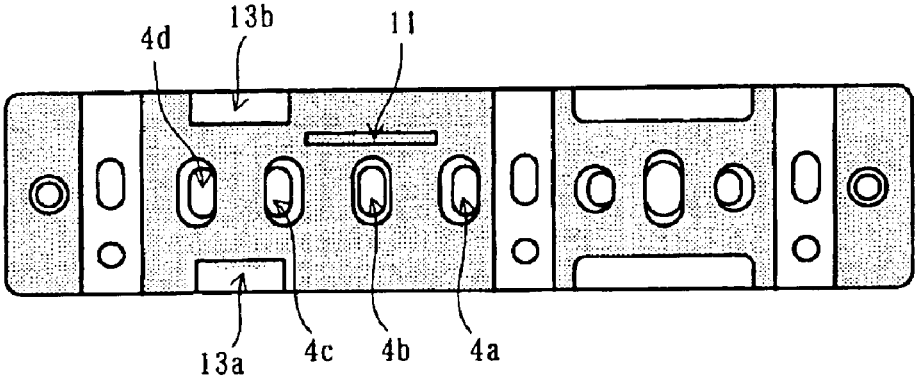

FIGS. 7A to 7C are front views of the dielectric duplexers of the second embodiment at their open-end side. In the dielectric duplexer in FIG. 7A, the left and right ends of the multipath slot 11 are folded down so as to come close to the resonant through holes 4*a* and 4*c*. With this structure, the capacitive coupling between the resonant through holes 4*a* and 4*c* may be larger than the capacitive coupling between the resonant through holes 4*a* and 4*b* and larger than the capacitive coupling between the resonant through holes 4*b* and 4*c* in order to determine the frequency and attenuation of the attenuation peak occurring at the lower-frequency side of the passband.

In the dielectric duplexer in FIG. 7A, the left and right ends of the step 13 are also folded up so as to come close to the resonant through holes 4*c* and 4*d*. With this structure, it is possible to efficiently yield the capacitive coupling between the two resonators even when the step 13 is small in area.

In the dielectric duplexer in FIG. 7B, the multipath slot 111 and the step 13 respectively have shapes different from those in FIG. 7A. The shape and size of the multipath slot 11 and the step 13 may be determined as required.

In the dielectric duplexer in FIG. 7C, steps 13*a* and 13*b* are formed in order to generate a capacitance between the steps 13*a* and 13*b* and an area near the open ends of the resonant through holes 4*c* and 4*d*. The capacitance between the above resonant through holes and the outer conductor 10 may be increased with this structure to increase the inductive coupling between the resonant through holes.

Although the resonant through holes 2*a* to 2*c*, 3, 4*a* to 4*d* and 5 are shown as stepped holes, each having a longitudinal cross-section shape in which the inside diameter is varied stepwise from the open end to the short-circuited end, in the first and second embodiments, they may be straight holes, each having a constant inside diameter from the open end and to the short-circuited end. Even with the stepped holes, the central axis of the inside diameter of each of the resonant through holes 2*a* to 2*c*, 3, 4*a* to 4*d* and 5 at the open end may coincide with the central axis of the inside diameter thereof at the short-circuited end, instead of a case in which the central axis of the inside diameter of each of the resonant through holes 2*a* to 2*c*, 3, 4*a* to 4*d* and 5 at the open end is deviated from the central axis of the inside diameter thereof at the short-circuited end. In either case, the same effect can be achieved with the multipath slot 11 and the step 13.

Although all of the dielectric duplexers in the first and second embodiment have the transmission filter and the reception filter in a single dielectric block 1, the present invention can also be applied to a simple bandpass filter that has the respective attenuation peaks at the higher-frequency side of the passband and at the lower-frequency side thereof.

Figure 8:
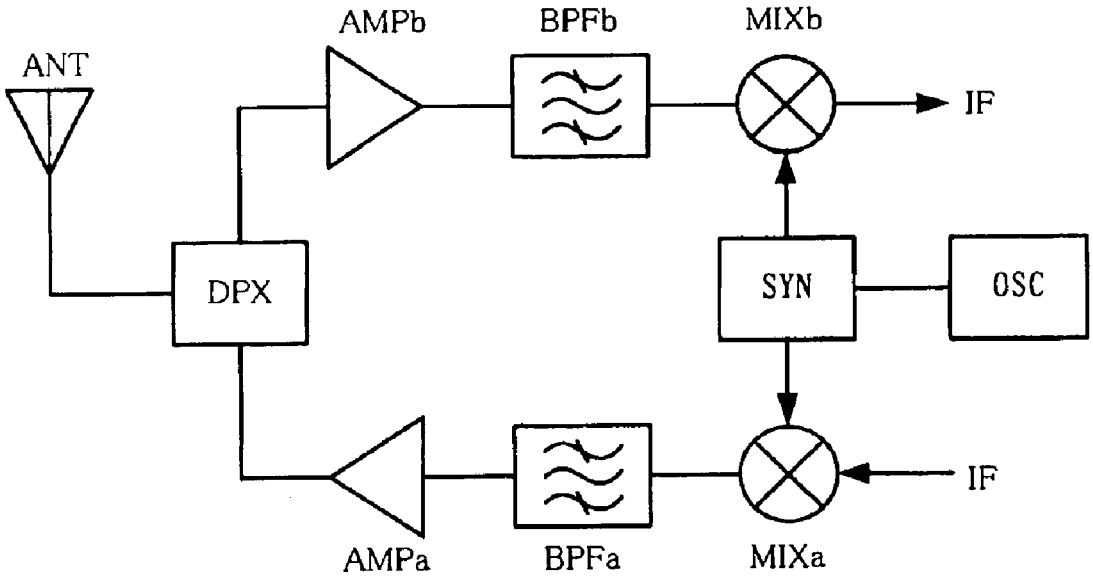
FIG. 8 is a block diagram showing a structure example of a communication apparatus according to a third embodiment of the present invention.
Figure 9A:
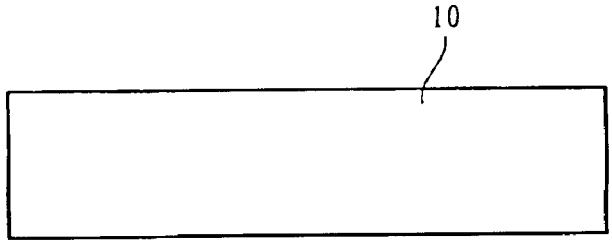
FIG. 9A PRIOR ART
FIG. 9A shows a structure example of a known dielectric duplexer and is a top view of the dielectric duplexer.
Figure 9B:
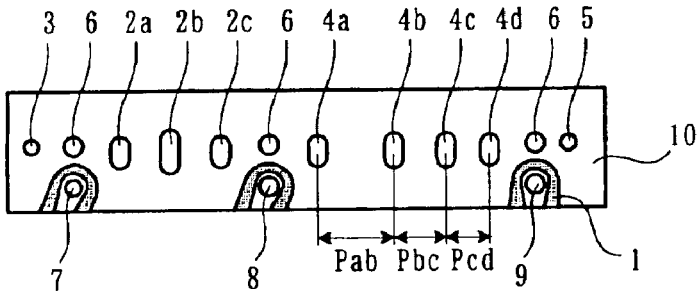
FIG. 9B PRIOR ART
FIG. 9B is a front view of the known dielectric duplexer.
Figure 9C:
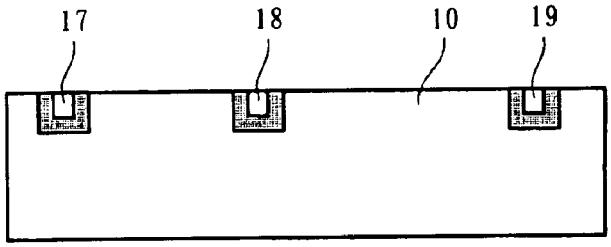
FIG. 9C PRIOR ART
FIG. 9C is a bottom view of the known dielectric duplexer.
Figure 9D:
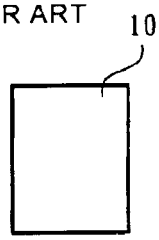
FIG. 9D PRIOR ART
FIG. 9D is a right-side view of the known dielectric duplexer.
Figure 10:
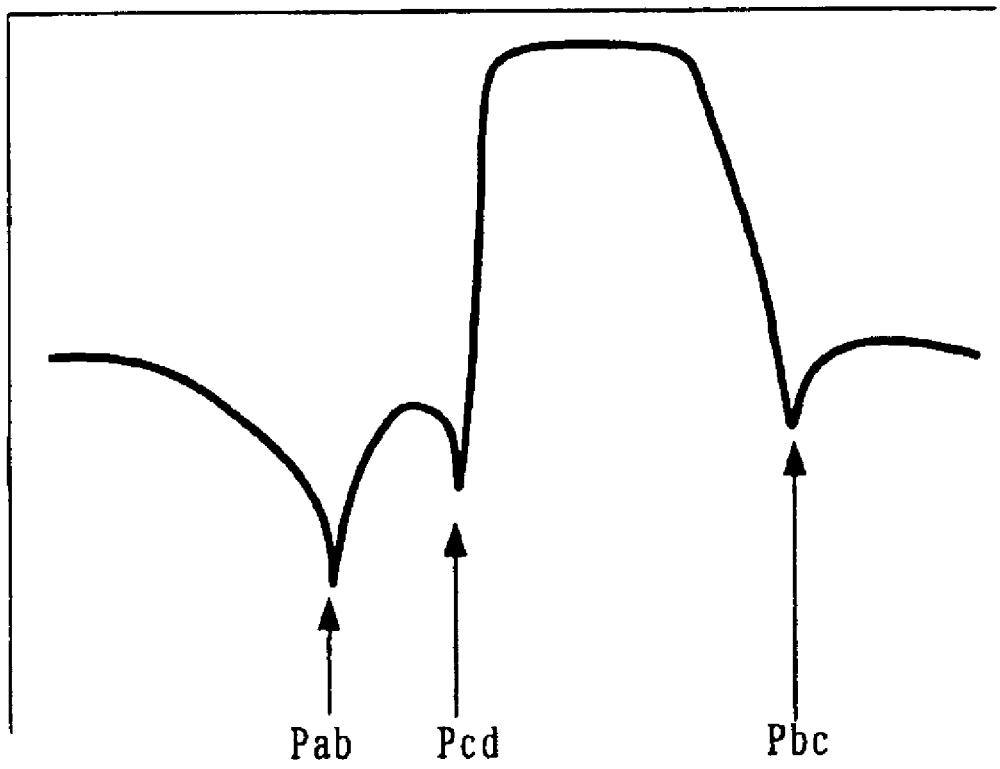
FIG. 10 PRIOR ART
FIG. 10 is a graph showing a transmission characteristic of a reception filter in the known dielectric duplexer in FIGS. 9A to 9D.

FIG. 8 is a block diagram showing a structure example of a communication apparatus according to a third embodiment of the present invention. Referring to FIG. 8, the communication apparatus has a transmission-reception antenna ANT, a duplexer DPX, bandpass filters BPFa and BPFb, amplifiers AMPa and AMPb, mixers MIXa and MIXa, an oscillator OSC, and a frequency synthesizer SYN.

The mixer MIXa mixes transmitted intermediate-frequency signals IF with signals supplied from the frequency synthesizer SYN. The bandpass filter BPFa transmits only signals within a transmission frequency band among the mixed signals supplied from the mixer MNIXa. The amplifier AMPa amplifies the signals transmitted from the bandpass filter BPFa. The amplified signals pass through the duplexer DPX and are sent through the transmission-reception antenna ANT. The amplifier AMPb amplifies received signals supplied from the duplexer DPX. The bandpass filter BPFb transmits only signals within a reception frequency band among the received signals supplied from the amplifier AMPb. The mixer MIXb mixes baseband signals supplied from the frequency synthesizer SYN with the received signals and outputs received intermediate-frequency signals IF.

Any of the dielectric duplexers according to the first and second embodiments is applied to the duplexer DPX in FIG. 8. Among the dielectric duplexer of the first and second embodiments, the dielectric filter having the structure of the transmission filter is applied to the bandpass filter BPFa and the dielectric filter having the structure of the reception filter is applied to the bandpass filter BPFb.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block;

at least four resonant through holes that are adjacent and parallel to each other provided in the dielectric block, each of the resonant through holes having a respective conductor formed on an inner surface thereof;

an outer conductor formed on at least one outer surface of the dielectric block;

a multipath slot formed within the dielectric block and having an inner conductor formed on an inner surface thereof, the inner conductor being separated from the outer conductor, the multipath slot being arranged near three adjacent resonant through holes among the at least four resonant through holes so as to generate a capacitance between a first area near an open end of each of the three adjacent resonant through holes and the inner conductor of the multipath slot; and a step formed on the dielectric block, the outer conductor extending within the step so as to generate a second capacitance between a second area near an open end of each of two resonant through holes among the at least four resonant through holes and the outer conductor within the step, the two resonant through holes including one of the three adjacent resonant through holes and a resonant through hole other than the three adjacent resonant through holes.

2. The dielectric filter according to claim 1, further comprising:

an excitation through hole formed within the dielectric block, the excitation through hole having a conductor formed on an inner surface thereof, the excitation through hole being coupled to any of the resonant though holes among the at least four resonant through holes.

3. The dielectric filter according to claim 1, further comprising:

a board upon which the dielectric block is mounted; and an input terminal and an output terminal formed on an outer surface of the dielectric block which is mounted on the board, wherein the multipath slot is arranged near an outer surface of the dielectric block opposite the outer surface of the dielectric block which is mounted on the board.

4. The dielectric filter according to claim 2, further comprising:

a board upon which the dielectric block is mounted; and an input terminal and an output terminal formed on an outer surface of the dielectric block which is mounted on the board, wherein the multipath slot is arranged near an outer surface of the dielectric block opposite the outer surface of the dielectric block which is mounted on the board.

5. A dielectric duplexer comprising:

a transmission filter; and a reception filter, wherein at least one of the transmission filter and the reception filter is the dielectric filter according to claim 1.

6. A dielectric duplexer comprising:

a transmission filter; and a reception filter, wherein at least one of the transmission filter and the reception filter is the dielectric filter according to claim 2.

7. A dielectric duplexer comprising:

a transmission filter; and a reception filter, wherein at least one of the transmission filter and the reception filter is the dielectric filter according to claim 3.

8. A communication apparatus comprising a communication-signal processing circuit, the communication signal processing circuit including the dielectric filter according to claim 1.

9. A communication apparatus comprising a communication-signal processing circuit, the communication signal processing circuit including the dielectric filter according to claim 2.

10. A communication apparatus comprising a communication-signal processing circuit, the communication signal processing circuit including the dielectric filter according to claim 3.

11. A communication apparatus comprising a communication-signal processing circuit, the communication signal processing circuit including the dielectric duplexer according to claim 5.

12. A communication apparatus comprising a communication-signal processing circuit, the communication signal processing circuit including the dielectric duplexer according to claim 6.

13. A communication apparatus comprising a communication-signal processing circuit, the communication signal processing circuit including the dielectric duplexer according to claim 7.

* * * * *